United States Patent [19]

Frazier

[11] 3,991,574

[45] Nov. 16, 1976

[54] FLUID PRESSURE POWER PLANT WITH DOUBLE-ACTING PISTON

[76] Inventor: Larry Vane W. Frazier, 1460 Exeter Ave., Ventura, Calif. 93003

[22] Filed: Feb. 3, 1975

[21] Appl. No.: 546,229

[52] U.S. Cl. ..... 60/645; 60/325; 60/643; 60/670; 417/318; 417/401; 417/404; 417/379; 91/306

[51] Int. Cl.[2] ..... F01K 27/00

[58] Field of Search ..... 91/306; 417/401, 404, 417/379, 318; 60/325, 670, 643, 645

[56] References Cited

UNITED STATES PATENTS

| | | | |
|---|---|---|---|
| 580,161 | 4/1897 | Owens | 417/404 |
| 1,437,704 | 12/1922 | Barrance | 417/318 |
| 2,296,647 | 9/1942 | McCormick | 91/306 |
| 2,349,150 | 5/1944 | Falasconi | 417/318 |
| 2,379,841 | 7/1945 | Thomas | 417/318 |
| 2,938,347 | 5/1960 | Sturgis | 60/325 UX |
| 3,465,686 | 9/1969 | Nugler | 91/306 X |
| 3,848,415 | 11/1974 | Demetrescu | 60/595 |

*Primary Examiner*—Allen M. Ostrager
*Attorney, Agent, or Firm*—Richard S. Sciascia; Joseph M. St.Amand; David O'Reilly

[57] ABSTRACT

A fluid pressure power plant which converts heat energy, externally generated, to high hydraulic pressure. The system generates heat energy in the form of steam or hot gas, supplies the heat energy to a double-acting intensifier piston which converts the heat energy to high hydraulic pressure which is stored in an accumulator. The high pressure hydraulic energy stored in the accumulator is used to drive hydraulic motors or turbines through hydraulic output control valves. The system operates on a demand cycle in that no energy input from the heat generator and power conversion piston is necessary until there is some demand for power output from the hydraulic accumulator, once said accumulator is fully charged.

9 Claims, 8 Drawing Figures

FLUID PRESSURE POWER PLANT WITH DOUBLE-ACTING PISTON

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates generally to power plants and more particularly to a power plant which converts heat energy to hydraulic power.

Presently in the operation of almost all power systems, energy in the form of heat is thrown away in huge quantities. Heat is thrown away in the form of unused power developed because of the necessity to maintain engine speed and angular momentum of mechanical drive lines, etc. In conventional systems there is only one chance to use the heat energy and that is the time when it resides in the kinetic energy of expanding a gas or a vapor. After that it is unwanted heat which is detrimental to engine components and must be dissipated. The development of unused power also results in a gross waste of fuel. Atmospheric contamination and combustion noise are additional problems of conventional systems.

SUMMARY OF THE INVENTION

The purpose of the present invention is to provide a high efficiency, demand cycle power plant which eliminates some of the disadvantages of conventional systems. The system uses either steam or hot gas for the energy input. In the steam system, a steam generator supplies energy to a power converting piston which transforms the input energy into output energy in the form of high hydraulic pressure. The output power hydraulic pressure is stored in a high pressure accumulator which in turn drives energy utilization devices such as one or more hydraulic motors or turbines through hydraulic output control valves. Since the system uses external combustion in the form of a steam generator to produce the energy input, it has the advantage over conventional systems of being low in noise and air pollution. Another advantage is that the system is highly efficient because it operates on a demand cycle. That is, the system is arranged so that no energy input from the steam generator is necessary until there is some demand for power output from the hydraulic accumulator.

The hydraulic fluid used to produce the power output is continuously circulated around a closed cycle. The hydraulic fluid is pumped from a main reservoir to a low pressure hydraulic accumulator and then to the power converting pistons. The power converting pistons then force the hydraulic fluid under high pressure into the high pressure hydraulic accumulator. The high pressure hydraulic fluid is then used to drive one or more hydraulic motors or turbines. The hydraulic fluid is then recirculated back to the main reservoir. The main reservoir also provides the fluid for the steam generator.

The system is highly efficient because of the use of a demand cycle, but a further increase in efficiency can be made by using thermal jacketing to reduce heat losses. Another important feature of the invention is that it is simple in construction and highly adaptable to be changed to meet future power requirements. For example, efficiency can be improved by use of the resonantly operated double-action piston arrangements disclosed herein. The components of the system need not be centrally located as is the case in the conventional engine. Also, the system requires no gear train, driven axle or crankshaft, except at the power output. This further increases the system reliability.

OBJECTS OF THE INVENTION

It is an object of the present invention to provide a power plant which employs an expanding gaseous medium to create a body of fluid under pressure which may be used to perform work.

Another object of the present invention is to provide a power plant which employs steam as the expanding gaseous medium.

Yet another object of the present invention is to provide a power plant which employs a hot gas as the expanding gaseous medium.

Still another object of the present invention is to provide a power plant which enhances efficiency by operating only on occasions of demand.

Another object of the present invention is to provide a power plant which uses a double-acting power conversion piston to improve efficiency.

Yet another object of the present invention is to provide a power plant in which the double-acting piston is operated at resonant frequency to improve efficiency.

Another object of the present invention is to provide a power plant which is low in noise and air pollution.

Yet another object of the present invention is to provide a power plant which is readily adaptable to increased power requirements.

Still another object of the present invention is to provide a power plant with improved maintenance characteristics by eliminating the need for gears, axles or shafts.

Other objects, advantages and novel features of the invention will become apparent from the following detailed description of the invention when considered in conjunction with the accompanying drawings in which like reference numerals indicate identical components throughout the figures.

DETAILED DESCRIPTION OF THE PREFERRED EMBODIMENT

This application is an improvement over application Ser. No. 325,271 filed Jan. 23, 1973, by Larry Vane W. Frazier entitled "FLUID PRESSURE POWER PLANT", now U.S. Pat. No. 3,839,863.

Figure 1:
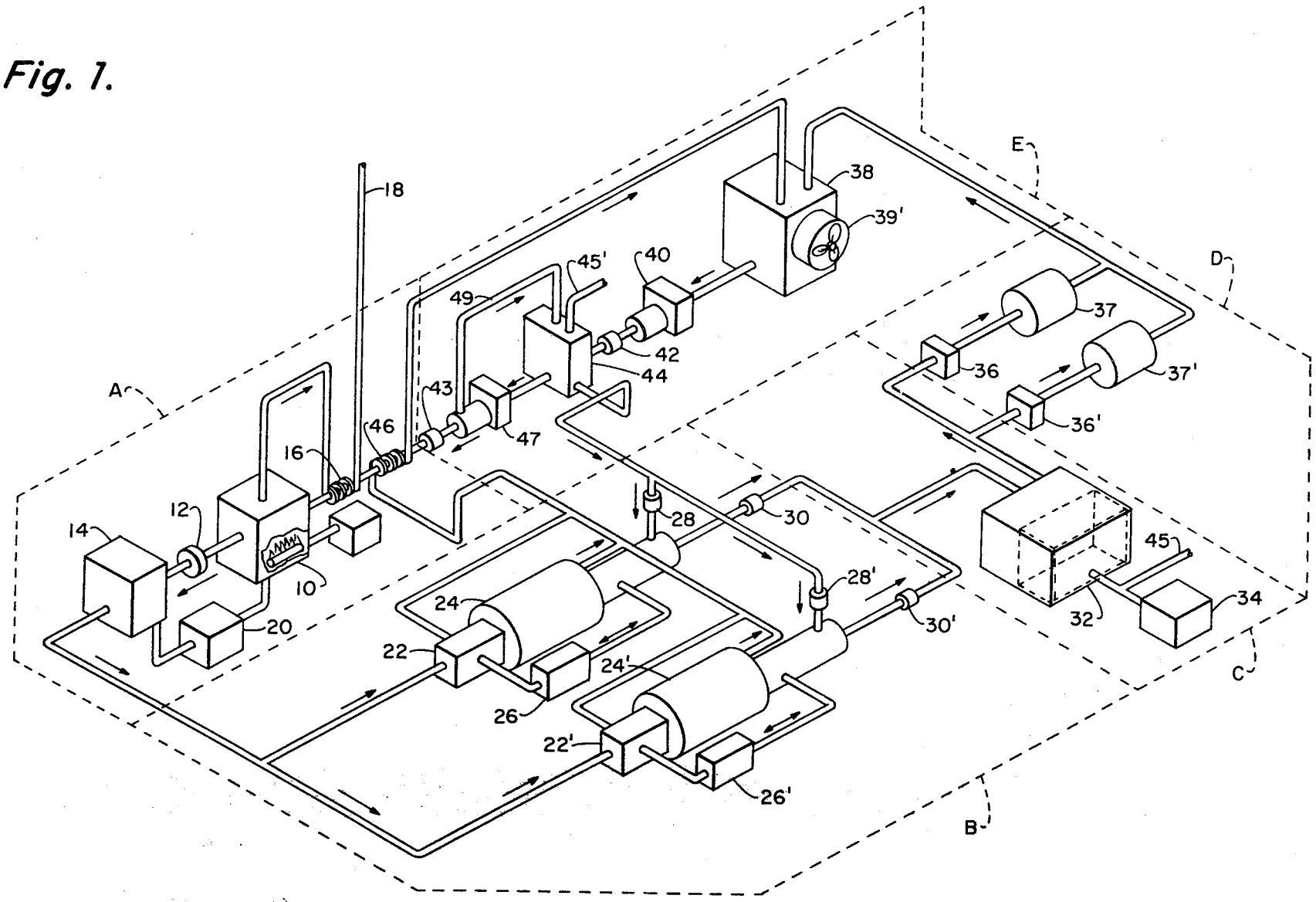
FIG. 1 is a fluid flow schematic diagram of an embodiment of the present invention where the expanding gaseous medium is steam.

Since both the steam and hot gas systems comprise a closed cycle process which only serves as a medium for transportation, distribution, and transformation of the energy between the power input and output, one must establish an arbitrary point in the cycle as the beginning. The energy input, which in the system shown in FIG. 1 is the steam generator, is an obvious starting point. For purposes of analysis, the system can be subdivided into a number of subsystems according to function as shown by the dashed lines in FIG. 1. In that figure the sybsystem designated A is the energy input generating subsystem. That designated B is the power conversion subsystem. That designated C is the hydraulic pressure storage subsystem. That designated D is the power output subsystem and that designated E is the fluid supply and low pressure hydraulic subsystem.

Beginning with the energy input subsystem A, steam is generated in boiler 10 and fed through check valve 12 to steam accumulator 14. In order to improve the efficiency of the system, the exhaust from the steam generator 10 may be fed through a heat exchanger 16 to preheat the fluid coming into the steam generator, and may then be exhausted to the atmosphere at 18. Pressure in steam accumulator 14 is sensed and a control signal is fed back through feedback control 20 to the steam generator 10 to turn off the latter when the pressure reaches a certain limit.

The power conversion system includes intake and exhaust valves 22 and 22' power conversion piston units 24 and 24' and a number of check valves 28, 28', 30 and 30' for controlling input and output of hydraulic fluid. In addition, the hydraulic fluid may be fed through an orifice restriction 26 and 26' to cushion the operation of the intake and exhaust valves. Orifice restriction 26 is an adjustable valve such as a needle valve, throttling valve, etc. It should be adjustable such that the reaction of the intake and exhaust valves 22 and 22' to the pressure changes in line 60 (FIG. 2) may be varied in order to optimize performance. Check valves 28 and 28' control the input of fluid to the power output side of power conversion piston units 24 and 24'. Check valves 30 and 30' control the output of the high pressure hydraulic fluid to high pressure hydraulic accumulator 32. The high pressure accumulator 32 may be of the air chamber type illustrated in which a bladder is preloaded with air to a particular pressure. However, other types of pressure accumulators would also be suitable.

The high pressure hydraulic accumulator subsystem C stores the hydraulic fluid under high pressure for use on demand by the power output subsystem D. The air head provided by a suitable source such as the preload air compressor 34 is the compressible medium which allows the hydraulic fluid to build up and to diminish on a demand basis. This high pressure hydraulic accumulator action also functions to smooth out the pulsations of the individual piston movements.

The hydraulic output control valves 36 and 36' control the flow of power to hydraulic power output units 37 and 37'. These units may be in the form of hydraulic motors, turbines or whatever is dictated by the use for which the system is employed.

Fluid for the entire fluid cycle is furnished by the main fluid reservoir 38, maintained at atmospheric pressure or less for maximum pressure gradient across the power conversion units 37 and 37', and especially to maintain a low pressure in condenser 46. A low pressure in condenser 46 aids in reducing the residual steam pressure in the power conversion pistons on the upstroke, thus adding to overall system efficiency. Low pressure hydraulic recycle pump 40 pressurizes low pressure hydraulic accumulator 44 through check valve 42 and supplies the fluid to steam generator 10 through another check valve 43. Centrifugal separator 47 may or may not be used as will be more fully explained hereinafter. Low pressure hydraulic accumulator 44 also provides the recycle pressure for power conversion piston units 24 and 24' as will be more fully explained in conjunction with FIGS. 2 and 3 hereinafter. Input check valve 42 prevents low pressure hydraulic accumulator 44 from supplying back pressure to the low pressure hydraulic recycle pump 40.

The system is purely a demand system. When the power output units 37 and 37' are drawing no power, the pressure in the high pressure hydraulic accumulator 32 builds to the maximum obtainable by the power conversion piston units 24 and 24', which may be anywhere from 1800 psia to 3000 psia. Whenever this occurs, the power conversion piston units cease to operate and the pressure in the steam accumulator 14 builds to a preset value at which point the energy input subsystem A shuts down. The static head in the low pressure hydraulic accumulator 44, supplied from preload air compressor 34 through line 45 to 45' or some other source, reaches the maximum deliverable pressure (approximately 150 psia) of low pressure hydraulic recycle pump 40, which then ceases to pump. A pressure regulator (not shown) may be required in line 45 to 45' because of the pressure difference between accumulators 32 and 44. As the demand by the power conversion units 37 and 37' increases, the power conversion piston units 24 and 24' start to work, but only to meet the demand since no zero-power cyclic phenomena are present. There is absolutely no power developed by the system except when there is power consumed by the power conversion units. The system is flexible and can be adapted to meet any power requirements by employing parallel components in any or all of the subsystems A through E, as required.

Figure 2:
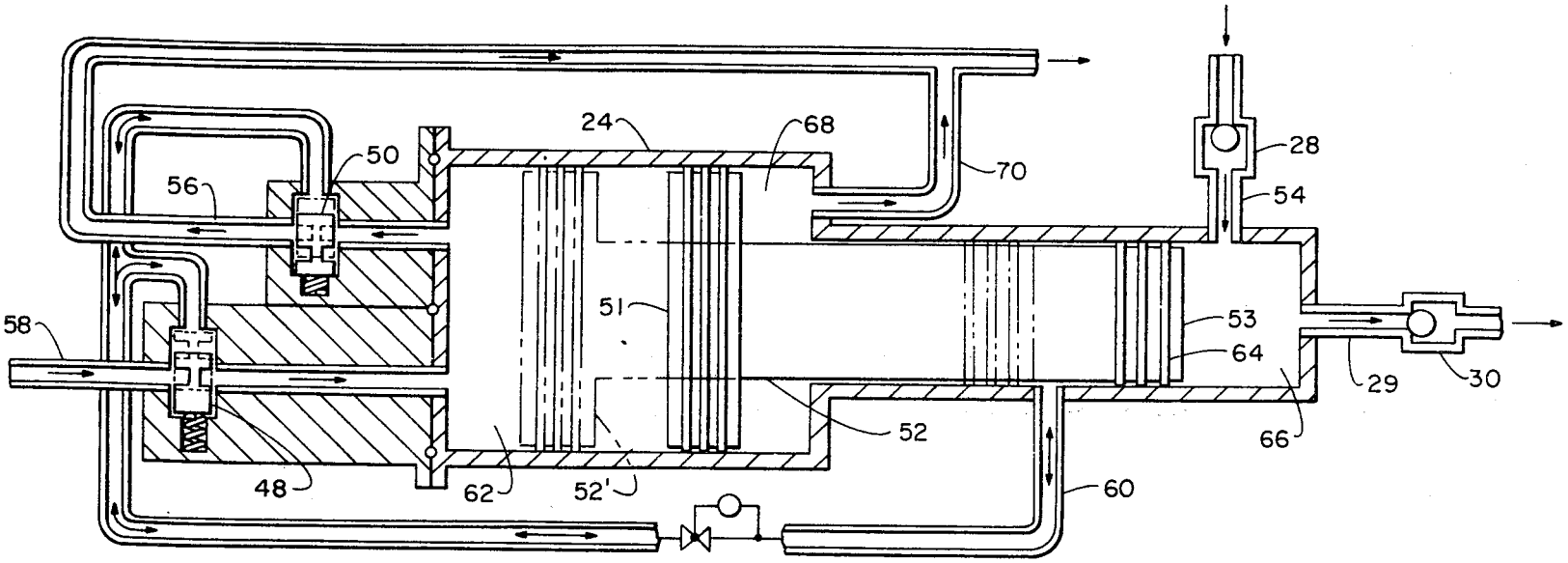
FIG. 2 is a longitudinal cross-sectional view of a power conversion piston illustrating the operation of the intake and exhaust valves.

A detailed section view of power conversion piston 24 of the steam system shown in FIG. 1 is illustrated in FIG. 2. The intake and exhaust valves 48 and 50 are shown in the intake position with piston 52 near the bottom of its stroke. When piston 52 reaches the bottom of its stroke just short of low pressure fluid input line 54, the intake and exhaust spool valves 48 and 50 will reverse position and the exhaust port 56 will be open and the intake port 58 closed. As low pressure fluid comes in the low pressure fluid input line 54, the piston 52 will start to rise, forcing the exhaust materials out the exhaust port 56. When the piston 52 reaches the position shown in dotted lines 52, the low pressure fluid will begin to flow through line 60 to the spool valves. The low pressure fluid will force the spool valve 50 closed, stopping flow through exhaust line 56 and the intake valve 48 will then open, allowing ingress of steam through line 58. At this time, steam begins to come into upper piston chamber 62, starting downward movement of piston 52. When lower piston ring(s) 64 get beyond the line 60 from the low pressure fluid chamber 66 to the spool valves 48 and 50, the low pressure fluid, which forced the spool valves 48 and 50 into the intake position, begins to drain off into the chamber 68 and out exhaust port 70 at the bottom of the chamber 68. It should be noted that as piston 52 starts its downward stroke, line 60 will momentarily be under high pressure. The position of line 60 can be varied to control at what point in the cycle of the piston 52 the valves 48 and 50 open and close. Again, when the piston 52 reaches the bottom of its downward stroke, the spool valves 48 and 50 will reverse, opening the exhaust port 56 and closing the intake port 58. With each downward stroke, the hydraulic fluid forced into the chamber 66 at low pressure will be forced at high pressure through the check valve 30 in the line 29 from the bottom of the power output side of the piston chamber 66. A suitable pressure gradient across the piston 52 was determined to be about twelve to one, however, other values may be used, if desired. That is, the ratio of the area of the top 51 of the piston to the bottom 53 of the piston is about 12 to 1.

The steam coming from exhaust port 56, along with the low pressure hydraulic fluid flowing in line 70 are both fed to the condenser 46. Some of the heat from the steam is reclaimed in this condensing process and also used to pre-heat the hydraulic fluid being fed to the boiler 10. The use of reclaimed heat in heat exchanger 16 and condenser 46 to preheat the hydraulic fluid conserves energy and is an additional method of improving the overall efficiency of the system.

Figure 3:
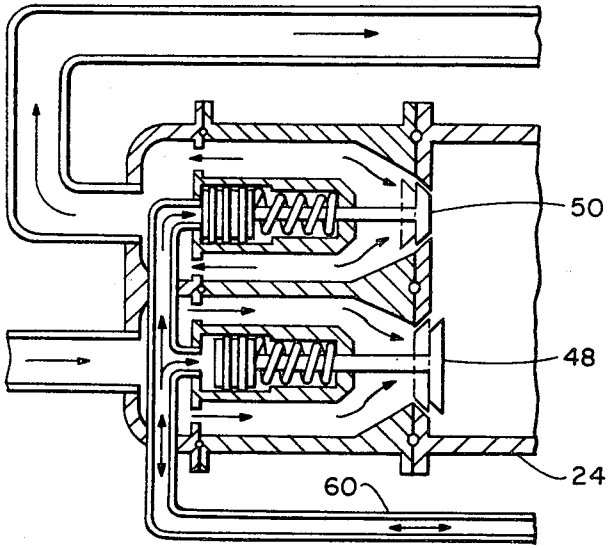
FIG. 3 illustrates an alternate arrangement of the intake and exhaust valves of FIG. 2.

FIG. 3 is another detailed section of the power conversion piston 24 with a different arrangement for the intake and exhaust valves 48 and 50. In this embodiment, the spool valves of FIG. 2 are replaced with poppet valves. They operate in substantially the same manner as the spool valves 48 and 50 of FIG. 2, except that they are more like the conventional poppet valves with the up and down motion. Again, as the low pressure fluid forces the piston 52 upward, fluid flows through the line 60 to the valves, forcing the intake valve 48 open and the exhaust valve 50 closed. When the piston 52 reaches the bottom of its stroke, the pressure is relieved from the poppet valves and the intake valve 48 closes while the exhaust valve 50 opens. The valve arrangements shown in FIGS. 2 and 3 are merely illustrative and other valve arrangements may be entirely suitable.

The steam system shown in FIG. 1 has two power conversion pistons 24 and 24', merely to illustrate that more than one power conversion piston may be used. However, only one power conversion piston may be used or any number may be used, as desired. Addtional power conversion pistons may be added as needed and the only limit on the number of power conversion pistons is the size of the main reservoir and the amount of energy output of the boiler. Additional pistons would be added in parallel with the existing pistons as piston 24'. It is important to note that each power conversion piston operates completely independent of any others. In other words, a power conversion piston may be added or removed from the system without affecting the performance of the other pistons. Likewise, the power output may be used by one or more hydraulic motors or turbines and as many as needed may be added within the limits of the system.

One distinct advantage over conventional systems is that the entire system may be in modular form. That is, each part may be located in a different area from another part and operates independently. For example, the main reservoir may be mounted on one part of the vehicle with the pump at another position and the accumulators at even different positions. Also, the power conversion pistons may be located in the frame, on the body, or, if desired, can be centrally located. The advantage of this is that if one portion of the system is damaged, it may be easily replaced. Or for example, if a power conversion piston is damaged, it may be removed or merely valved off and the system will still operate without it.

With this system mounted in a vehicle and spread out throughout the body and frame of the vehicle, it would be difficult to disable the system completely. Further, by valving on or off additional power conversion pistons, the power may be used as needed rather than using full power all the time.

One of the difficulties with some of the present systems is the problem of providing lubrication throughout the system. This is a problem because many of the materials for lubrication cannot go through the energy input cycle. However, there are many materials now which can be included in with the fluid used to supply the steam generator system and which can be separated out before the water or other fluid passes to the steam generator system. For this purpose, centrifugal separator 47 is inserted in the system after the low pressure hydraulic accumulator 44. There are a number of types of centrifugal separators which would be suitable for this system.

Fluids suitable for the vapor cycle have quite poor, generally, lubrication qualities and, therefore, a lubricant which has all the proper qualities for use in a hydraulic medium will most likely be required as an additive of some type. Thus, a fluid chosen which has a density significantly different from the hydraulic fluid can easily be separated in the centrifugal separator 47 and fed back through a line 49 to the low pressure hydraulic accumulator 44. Then only the hydraulic fluid capable of being used in the vapor cycle will pass to the boiler 10. The vapor to hydraulic fluid volumetric flow ratio is approximately 12 to 1 in this case (although it could be any ratio desirable). Also, the vapor mass flow rate is low compared to the hydraulic fluid mass flow rate. This fact is due to the several hundred to one volumetric expansion from liquid to vapor in the boiler. With these comparatively low flow rates, separation of the lubricant from the hydraulic fluid in the centrifugal separator does not present any problems. With the continuing discovery of new materials, a simpler solution to the lubrication/lubricant vapor cycling problem may be available. For example, a lubricant which can pass through the vapor cycle would eliminate the need for a centrifugal separator.

The most readily available hydraulic fluid, of course, would be water. However, the Mollier diagrams (Enthalpy versus Entropy) for some of the organic substances such as Dowtherm A, Dowtherm E, and Toluene show promise for increasing thermal efficiency. Selection of a suitable hydraulic fluid for the vapor cycle depends upon such factors as the properties desired and the cost.

Preferably the power conversion pistons 24 and 24' would operate on a full or partial expansion principle. This is because although the non-expansion pressure multiplication or intensifier piston described is the simplest, mechanically, it is less efficient than full or partial expansion pistons. The boiler steam delivered to the piston contains energy in the form of pressure and temperature. The non-expansion piston cannot take advantage of the internal energy represented by the temperature. An expansion piston converts both pressure and internal energy into work. For example, using a proposed boiler pressure of 150 psia, a partial-expansion piston cycle, expanding to 40 psia, provides a cycle efficiency of more than twice that of the non-expansion piston cycle. Efficiency enhancement by application of such techniques is described in detail in "Principles of Engineering Thermodynamics" by Kiefer and Stuart, published in 1949 by John Wiley and Sons, and in "Steam Power Plant Engineering" by Gebhardt, 6th Edition 1928, published by John Wiley and Sons.

In the proposed system, the use of a hydraulic accumulator 32 (FIG. 1) uncouples (i.e. isolates) the heat engine from the power demand and allows a simple on-off duty cycle. When supplying power, the heat engine operates under a single (or at most, two) set of conditions. The entire heat engine can then be built and tuned for maximum efficiency and minimum pollution emissions under these conditions. In the simplest case then, the entire heat engine is either operating at its peak efficiency and minimum pollution emission point, or it is off.

The power conversion pistons 24 and 24' are an integral part of the heat engine, supplying high pressure hydraulic fluid to the accumulator 32 for use as demanded. As such they also operate in the on-off duty cycle mode of the heat engine on a purely demand cycle. No external controls are required. The piston operates whenever the boiler pressure is nominal and the accumulator pressure drops below nominal.

The on-off duty cycle of the intensifier piston, as in the case of the combustor, allows fine tuning for maximum efficiency at the single operating point. Since the piston is "free-floating" (no mechanical power transmission), it can be tuned to resonate at the single operating point. Similarly, all fluid inlet and exhaust lines can also be sized to operate in resonance at that operating point. Energy losses in accelerating and decelerating engine component masses can be minimized by the resonant piston operation. Thermodynamic efficiency of the engine can also be improved by taking advantage of the inlet and exhaust line resonant operation to more efficiently move the fluids in and out of the power conversion piston cylinders. For resonant operation, a double-acting (power stroke in both directions) power conversion piston is preferred, with a non-condensing, partial-expansion vapor cycle. Vapor intake and exhaust locations similar to the "unaflow" steam engine concept are used for maximum thermal efficiency. The unaflow concept is explained in Applied Thermodynamics by V. M. Faires, MacMillan Co., N. Y., 1949.

It is believed that a partial-expansion steam cycle is most suitable to obtain reasonable cycle efficiencies. This cycle requires somewhat more complex valving than the non-expansion cycle. Further, in order to reduce piston sizes, it appears desirable to maximize the power output of the piston. Thus, it was concluded that a piston having a power stroke in both directions operated at high speeds is desirable.

The requirements of such a piston are that a clearance volume must be charged with steam at boiler pressure, locked in the cylinder while the steam expands, spent steam discharged to an exhaust and the piston returned to start. For the sake of operating and control simplicity, the piston should be self-actuating, i.e., operating whenever the hydraulic system demands fluid and the boiler is up to pressure. Also, to act as an intensifier piston, the steam/hydraulic piston area ratio must be such that during a power stroke the sum of the force on the steam piston or cylinder head, and the inertial force of the piston itself, are always greater than the force on the hydraulic piston area.

A double-acting hydraulic intensifier piston of this general type has been in existence for many years and is manufactured by the Racine Tool and Machine Company. This piston intensifies the pressure of a hydraulic fluid with the same fluid acting on both the large and small piston areas. Since hydraulic fluid is essentially incompressible, the design is of the "non-expansion" type and is not suitable for the "partial-expansion" cycle of the subject system. For this system considerable modification and a novel arrangement of the valving system is provided.

The main difference in valving results from the need to introduce a small quantity of the driving fluid (e.g. steam) into a clearance volume on the driving side of the cylinder, then trap that fluid while it expands in the power stroke. In the initial part of the power stroke, before the steam has begun to expand, the force on the driving piston will greatly exceed the force on the hydraulic piston (roughly by the amount of the steam expansion ratio). Thus, unless restrained, the piston would begin accelerating well before the steam clearance volume was fully charged. Near the end of the power stroke, the two forces would be nearly balanced. The large unbalanced force driving the piston during the steam expansion in the power stroke also implies possible large piston velocities and high piston momentum. This can be employed advantageously to expand the steam well beyond the point where the balance of forces on the piston begins decelerating it. It also suggests the desirability of resonant piston operation.

Figure 2A:
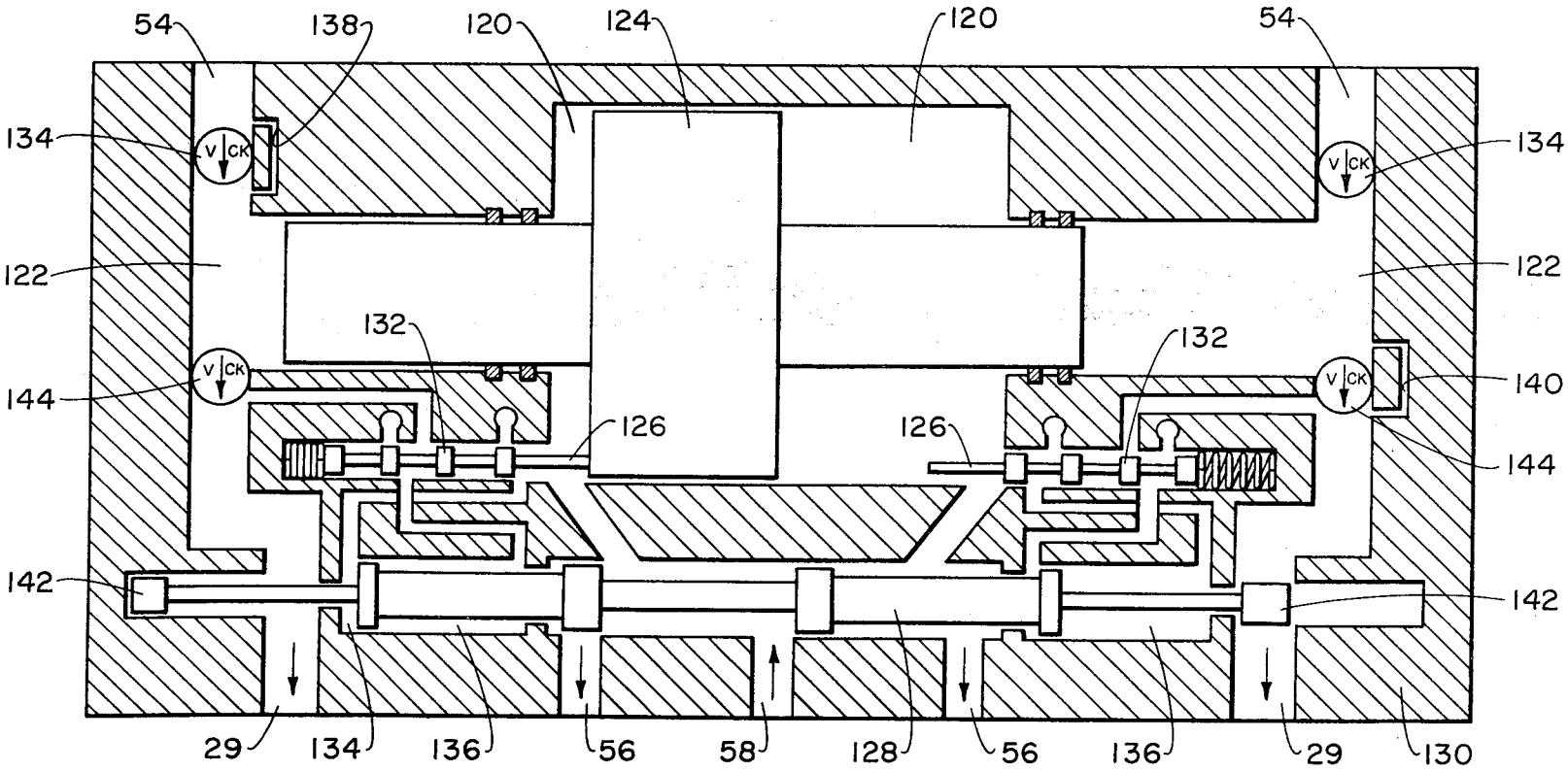
FIG. 2*a* is a longitudinal cross-sectional view of a double-acting power conversion piston which can be substituted in the system for the power conversion piston of FIG. 2.

FIG. 2*a* illustrates one possible design of a double-acting intensifier piston which will accomplish most of the above requirements. The inlet and exhaust lines for the working fluid and hydraulic fluid are numbered to correspond with the inlet and exhaust lines of the power converting piston of FIG. 2. The double-acting intensifier piston design is comprised of a piston 124 mounted in a housing 130, having spool valve 128 for control of the working fluid to cylinder head piston area 120 and pilot valves 132, operated by actuating pins 126. Hydraulic fluid is delivered to the double-acting piston areas or hydraulic chambers 122 through lines 54 having therein check valves 134. Identical parts on either side of the piston are numbered identically to show the symmetrical construction of the double-acting piston.

The position of the piston 124 and spool valve 128 in FIG. 2*a* shows one of the significant differences in valving from that of the prior art, referred to above. When the piston 124 has moved sufficiently far to the left to move the actuating pin 126 of pilot valve 132 fully to the left, the spool valve cavities 134 and 136 are connected to the working fluid (e.g. steam) piston area 120 and input accumulator pressure line 29, respectively. Initially the spool valve 128 will be in a position to the right of center such that the right side power cylinder working fluid piston area 120 or expansion chamber is blocked, while the left side expansion chamber 120 is opened to exhaust. Accumulator pressure, through line 29, to spool valve cavity 136, working on the "balance piston" area between cavity 134 and cavity 136, will move the spool valve to the left until it comes to rest in the position shown in FIG. 2*a*. In this position, the working fluid intake line 58 is connected to the left side working fluid piston area 120 while the right side of the working fluid piston area 120 is connected to exhaust, and the discharge of the right side hydraulic cylinder is blocked. The spool valve 128 is then held in this position while working fluid pressure builds up in the left side heat expansion chamber 120 and in the spool valve cavity 134. The spool valve piston areas, exposed to cavity 134 and 136, are designed such that when the pressure ratio between the spool valve area 134 and 136 reaches approximately the design working fluid expansion ratio, the forces on the spool valve 128 become unbalanced to the right and spool valve motion to the right begins. When the spool valve 128 has moved sufficiently to the right to open the right hydraulic cylinder discharge line to the accumulator 29, and block the intake port 58 to the left piston area 120, the working fluid is free to begin forcing the power piston 124 to the right, expanding in the power stroke. When the power piston 124 moves to the right sufficiently to release the actuating pin 126, both spool valve areas 134 and 136 are vented to their respective reservoirs (not shown) and motion of the spool valve 128 ceases. An identical set of actions occur in revese when the power piston 124 arrives at the right actuating pin.

If the double-acting intensifier piston arrives in the position of FIG. 2*a* and accumulator pressure is high, the balance of forces across the spool valve 128 at areas 134 and 136 may be insufficient to move the spool valve and the entire assembly will stop in the position shown in the figure. On a subsequent duty cycle, i.e., when accumulator pressure drops, a demand is generated. The balance of forces will again become adequate and power cycling will automatically be initiated. For starting and to avoid inadvertent stalling of the power piston 124 between the two actuating ends 126, small bleed passages 138 and 140, involving insignificant hydraulic fluid flow rates, are provided to by-pass the check valves. These can slowly force the power piston to the left against the actuating pin 126 into the "cocked and ready" position, regardless of small residual working fluid pressures trapped in the power cylinder areas 120. This feature might also be provided by making hydraulic power piston/cylinder area 122 slightly larger than the other and retaining the by-pass passage 138. Then, equal reservoir pressures in both hydraulic cylinders would provide the unbalanced force to "cock" the piston to the left.

Figure 2B:
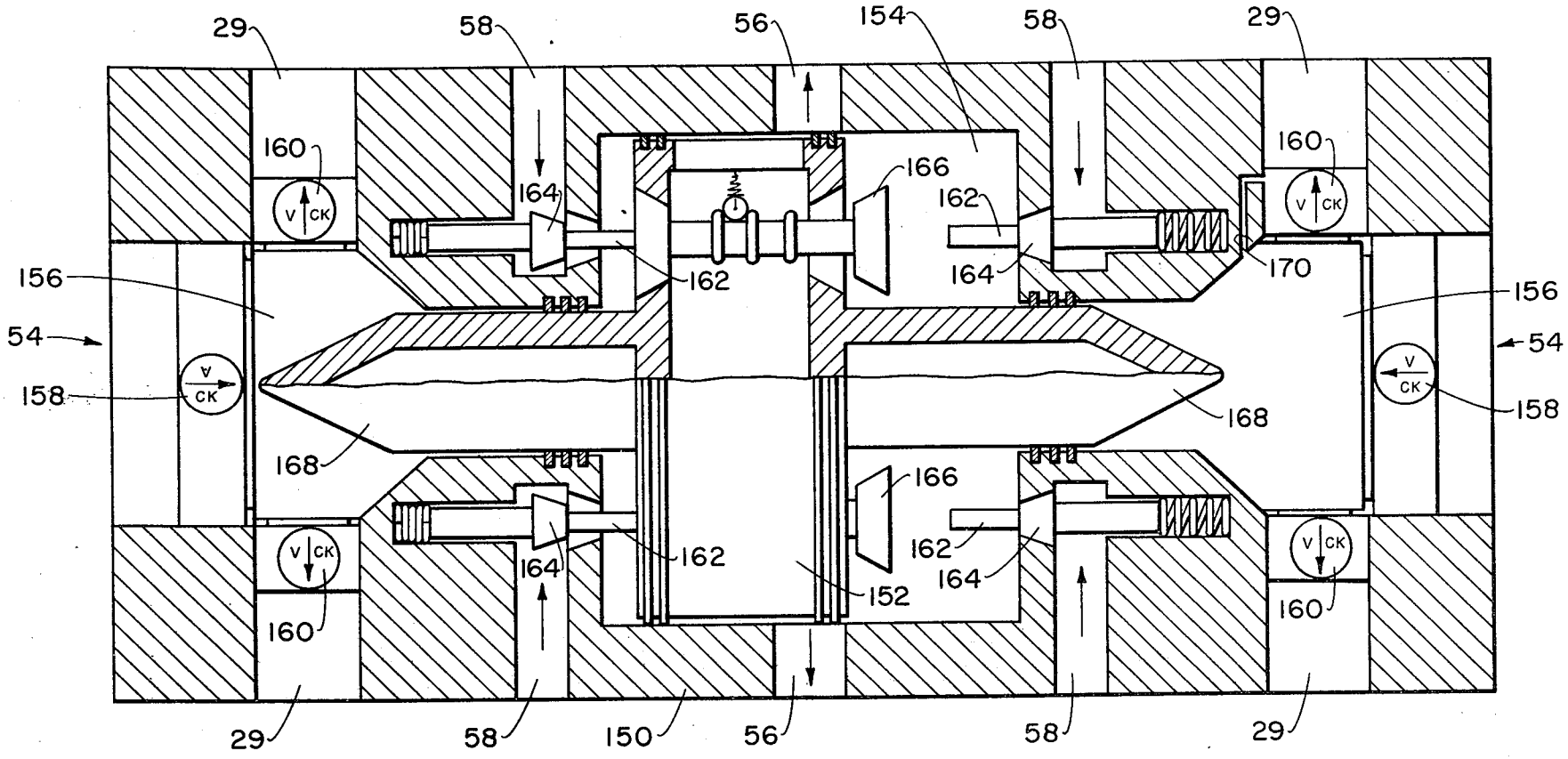
FIG. 2*b* is a longitudinal cross-sectional view of another design of a double-acting power conversion piston.

Intensifier piston design, as shown in FIG. 2*a* and discussed above, is one approach which seems feasible to provide the double-acting, demand-actuated, partial-expansion characteristcs necessary for the subject application. However, one difficulty with this design is that it may be limited to relatively slow cyclic speeds and probably could not be made as efficient as desired. The cyclic speed would probably be limited by the chain of events required from the time the power piston 124 contacts the actuating pin 126 until the piston breaks contact with the pin on the next power stroke. which appears to be a large fraction of the half cycle time. The piston 124 would spend a large fraction of the total operating time relatively stationary at the two ends of the cylinder. The cyclic speed would also probably be limited by hydraulic losses around the spool valve, blocking heads 142. If the hydraulic discharge line 29 to the accumulator were made large, to handle large flow volumes with low pressure losses, then the spool valve heads 142 would also have to be large. This would probably further slow the action of the spool valve and also yield large pressure losses as the piston gradually opened the discharge line. The design shown in FIG. 2*b* is for the purpose of eliminating some of the difficulties of the design of FIG. 2*a*.

Again, the intake and exhaust lines for the hydraulic fluid and heat energy are numbered identically with those of FIG. 2 for identical lines. This design is comprised again of a housing 150, a piston 152, a piston area or expansion chamber 154 for working fluid and piston area or hydraulic chamber 156 for fluid. Check valves 158 and 160 in lines 54 and 29, respectively, control the flow of hydraulic fluid to each side of the double-acting piston 152. As in the design of FIG. 2*a*, there are actuating pins 162, but in this design the pin 162 directly opens the intake poppet valves 164 by mechanical action. The sliding exhaust valves 166 are located in the steam piston cylinder head itself, as much away from the intake valves 164 as possible. Expanded steam exhausts through the hollow steam piston cylinder head 152, which is always open to exhaust ports 56. Spring forces in the intake and exhaust valves are such that as the pin 162 and exhaust valve 166 make contact, the exhaust valve 166 first moves (relative to the piston 152) to the closed position before the force on the pin 162 becomes large enough to force the intake valve 164 open against the combined force of the pressure differential (across the valve 164) and the spring. As the exhaust valve 166 closes, the valves on the other side of the piston open, exhausting the expended steam in that cylinder. Relatively large numbers of intake and exhaust valves (perhaps six or eight in each plane) may be provided to minimize throttling losses. With the design shown, only a small fraction of the piston cyclic motion and time is required to move the valves between the fully closed and open position. Relatively large intake and exhaust manifolds (not shown) should be provided to minimize line fluid friction losses.

The low pressure hydraulic fluid from the reservoir enters through relatively large lines 54 and check valves 158 into large hydraulic cylinder areas 156. It discharges radially through a number of check valves 160 into a collector manifold (not shown) through lines 29 and thence through relatively large lines to accumulators. The hydraulic piston 152 is somewhat conically shaped at 168 to develop an initial radial component of the hydraulic fluid velocity, toward the radial discharge ports, at check valves 160 as the hydraulic piston 152 drives into the fluid volume. The features described are provided to allow high peak piston velocities and high cyclic rates of operation with minimum hydraulic pressure losses. As shown in FIG. 2*b*, there is no provision in the design for stopping piston 152 in place while the working fluid piston area 154 is charged with a full head of heat energy as in the previous design. Instead, the exhaust and intake valves 164 and 166 are designed to close and open, respectively, as the piston 152 approaches an intake end and charge the clearance volume or heat expansion chamber 154 during the time the piston velocity passes through zero and reverses direction. This implies that the entire intensifier piston should be dynamically designed to operate near a single cyclic frequency. This dynamic design can yield benefits and, in fact, the entire double-acting intensifier piston system is designed to operate at resonance.

An on-off demand-actuated valve (not shown), of course, must be provided. For this, a balance-piston type valve will be suitable which is simply full open when the boiler-to-hydraulic accumulator pressure ratio is greater than that required for satisfactory cyclic operation of the intensified piston and closed when this ratio is not satisfied. The same small bleed passages as in the intensifier piston of FIG. 2*a* (i.e., small bleed passages 170) around the accumulator and reservoir check valves are provided to move the piston to, and hold it in, the "cocked and ready" position when not operating.

It is believed that the design of FIG. 2*b* provides a better basis for high efficiency operation than the design of FIG. 2*a*. The design is much more amenable to high speed, high cyclic rate operation than the previous design and can readily be dynamically "tuned" for resonant operation. Mechanical friction, heat losses and steam leakage obviously should be minimized. Fluid friction and throttling losses can be minimized by the use of relatively large intake and exhaust manifolds (not shown) and fast-acting, large total area valves. Further reduction in intake and exhaust line losses can be achieved by designing these lines, and the piston itself, all to operate in resonance at the design cyclic frequency. Initial steam condensation losses in the cylinder are minimized by employing the "unaflow" intake and exhaust valve orientation concept of prior art double-acting piston designs and by maintaining superheated working fluids in the cylinders. Actual piston dimensions depend upon the particular application of the piston.

The double-acting intensifier piston design shown in FIGS. 2*a* and 2*b* may be used in lieu of the power conversion pistons of FIG. 2. This is a simple matter of connecting the exhaust and intake lines (correspondingly numbered throughout the drawings) to the appropriate lines shown in FIG. 1. One double-acting piston of the type shown in FIGS. 2*a* and 2*b* may be used in lieu of two of the single-acting piston assemblies shown in FIG. 1 as 24 and 24'. In this case, the two lines going to power conversion piston cylinders 24 and 24' would merely be going to opposite ends of a single double-acting piston of FIG. 2*a* or 2*b* with proper attention to line (intensifier pistons) connections being taken into consideration. The intensifier pistons of FIGS. 2*a* and 2*b* could also be substituted in the system of FIG. 4 with the heat exchanger portion of these piston cylinders being external to the working area (i.e., heat expansion chamber) of the double-acting intensifier pistons.

Figure 4:
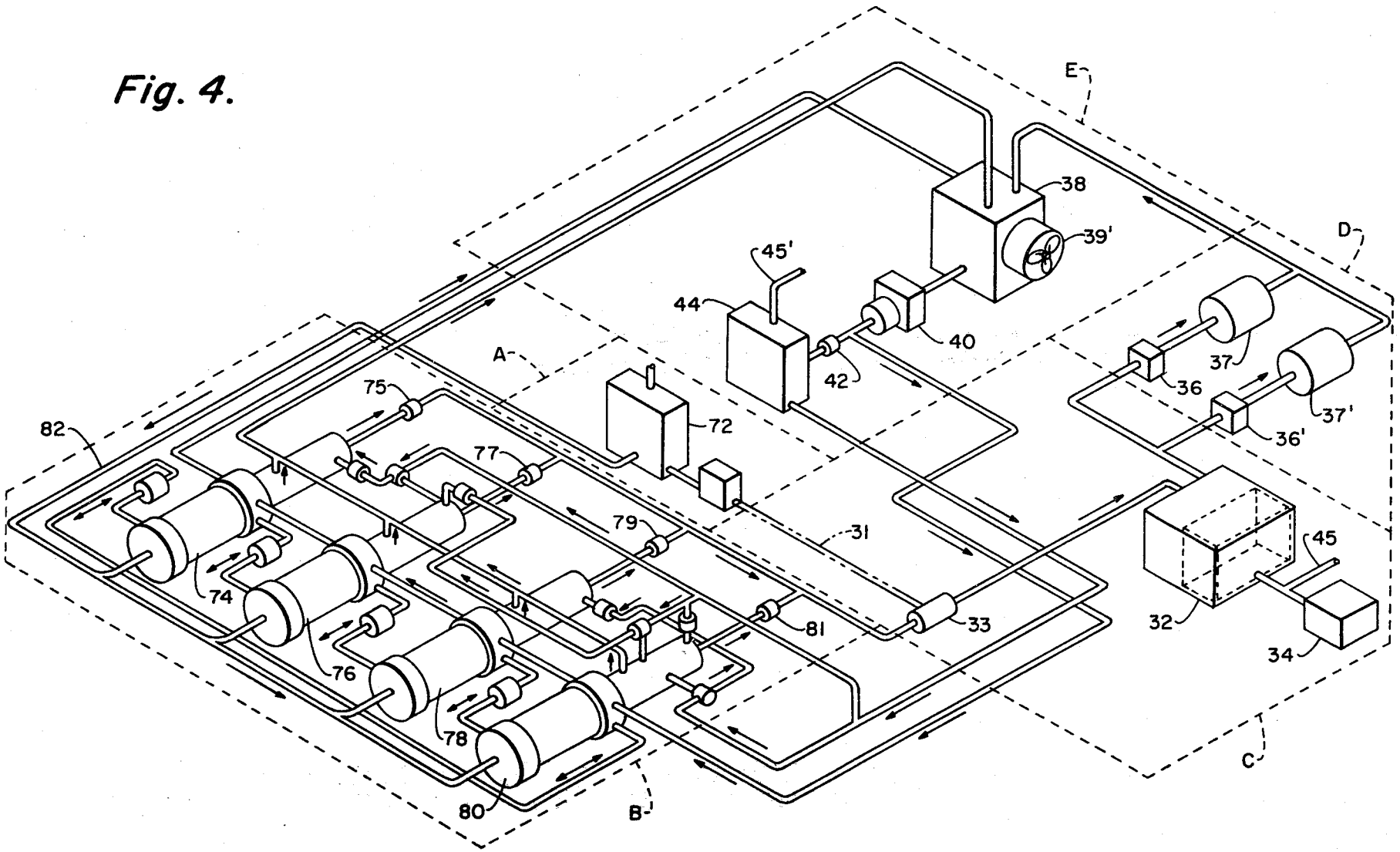
FIG. 4 is a fluid flow schematic diagram of an embodiment where the expanding gaseous medium is heated gas.
Figure 5:
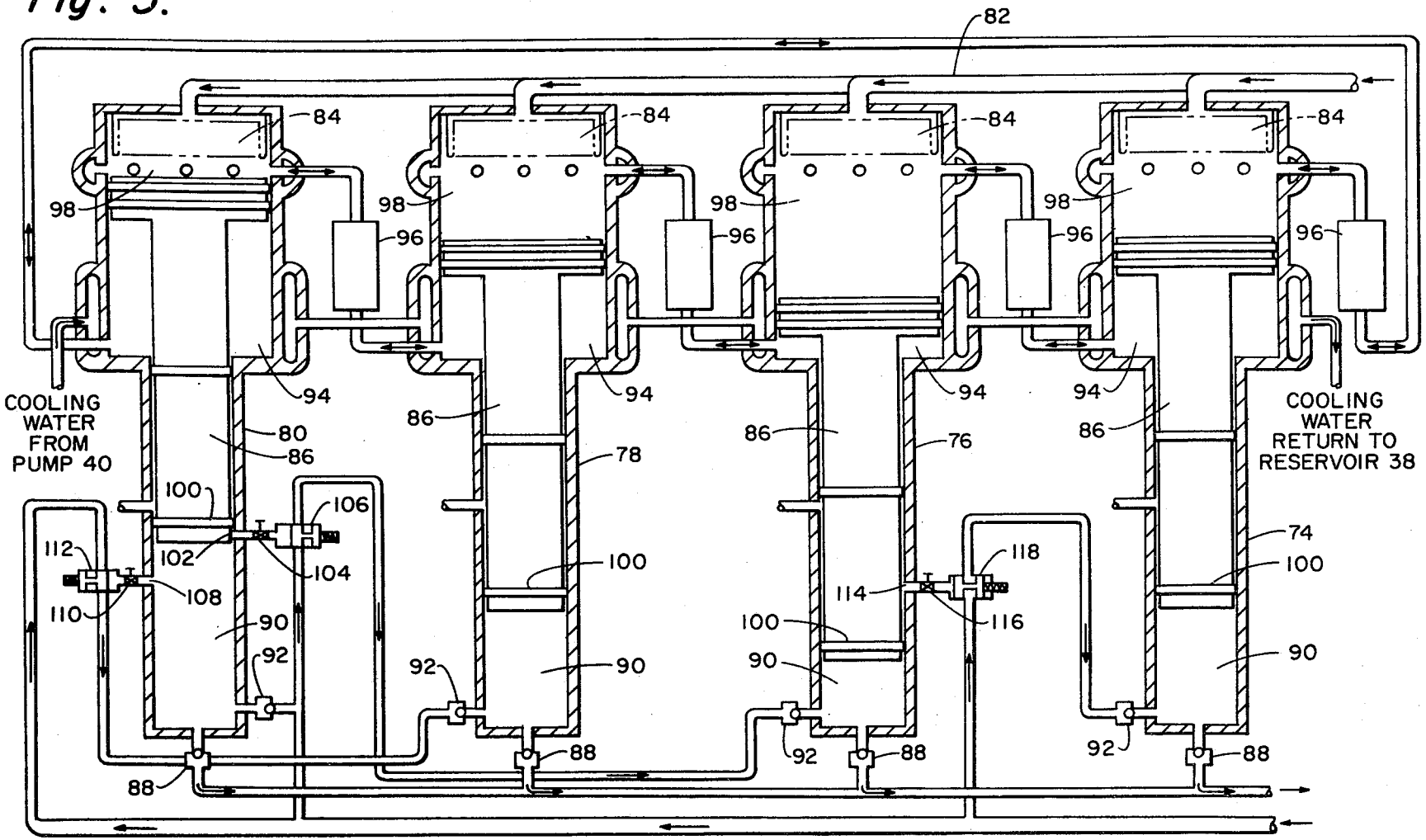
FIG. 5 is a cross-sectional view of a power conversion cylinder group used in conjunction with the hot gas system of FIG. 4.

The system shown in FIG. 4 is an alternative embodiment which operates on hot gas (such as air, nitrogen or helium) as the energy input rather than the vapor (i.e. steam) cycle and requires power conversion pistons in groups of four (or two of the double-acting pistons). As in the steam system, an arbitrary point was selected as the starting point, and in this case it was at the energy input, which is the heat source. Beginning with the heat source, the theory of operation shall be explained in the sequence in which the operational functions occur. Again, for clarification, the system is broken down into five subsystems. These are the heat generation subsystem A, the power conversion subsystem B, the energy storage and distribution subsystem C, the hydraulic output power utilization subsystem D, and the fluid supply and low pressure hydraulic subsystem E.

As in the steam system, the system of FIG. 4 is an external combustion engine employing hydraulic power transfer. A heat source is used to produce heat energy which is applied to the hot end of the power conversion cylinders 74, 76, 78 and 80. Direct heat transfer will suffice in the case where the heat source is built into the cylinders or, the heat source may be separate with heat transfer to the cylinders by the use of heat pipes as at 82. When this heat is applied to the cylinder heads, it causes the gas in the cylinder to expand, thus driving the respective pistons downward. The pistons are pressure multiplication pistons as in the steam system, the top end being several times as large in area as the lower end (e.g. a ratio of 4 to 1 might be suitable). Many such pistons can be employed in parallel to meet whatever power requirements are desired by the user; however, pistons function together in groups of four and multiples of four are required. Other than the grouping of four, no fixed number of pistons is required beyond the initial four. Obviously, the sizing of the entire system must be considered for the ultimate application of large numbers of pistons, etc. The requirement that the pistons be employed in groups of four derives from the fact that the pistons are phased 90° apart and are hydraulically interlocked to maintain this phase separation. The use of porting without valves, heat regenerators, and the hot-to-cold gas cycling requires the 90° phase relationship between pistons. A half stroke is 90°.

As the gas in the chamber expands, forcing the piston down, it drives a hydraulic fluid under high pressure through a check valve 75, 77, 79 or 81 into a high pressure accumulator 32, as in the steam system. The hydraulic pressure stored in the accumulator 32 is fed to power output units such as hydraulic motors or turbines 37 and 37' through output control valves 36 and 36'. The hydraulic fluid, after dissipating its energy, is then recycled to the main fluid reservoir 38. The fluid is then cooled and pumped to a low pressure hydraulic accumulator 44 from where it is fed to the power conversion cylinders and is recycled through the system.

Referring now to FIG. 7, there is shown a sectional view illustrating the function of the group of four power conversion cylinders 74, 76, 78 and 80. Heat is generated either directly in the top of the cylinders by a burner (not shown) or is fed to the cylinders through heat pipes 82, as shown.

Figure 6:
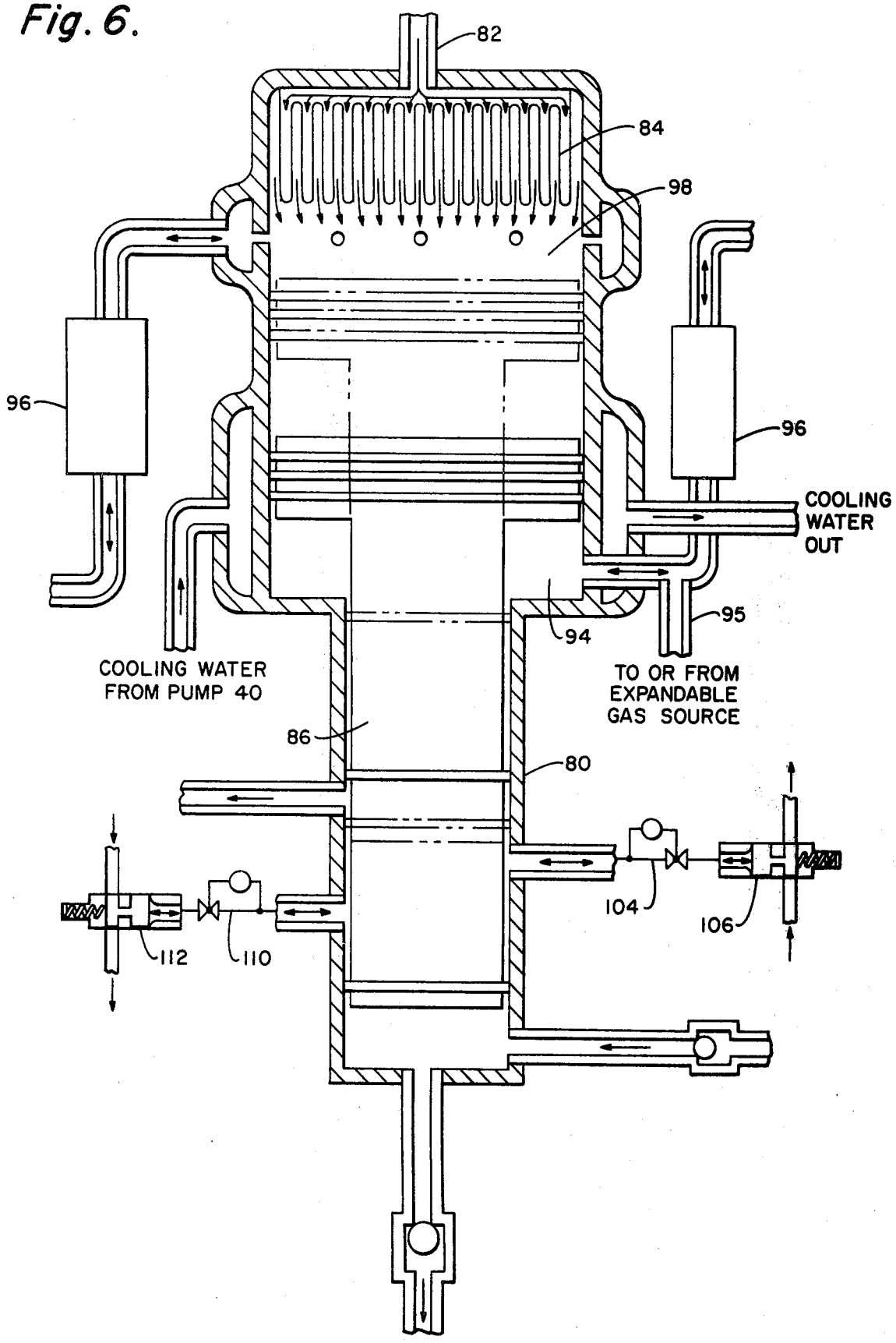
FIG. 6 is a cross-section through one of the power conversion cylinders of FIG. 5.

Direct heating by a burner is described in an article in the June 1971 issue of Popular Science, pages 54–56. In FIG. 6, the arrow associated with the heat pipe 82 shows direction of heat flow. The vapor flow and return capillary flow of fluid internal to the pipe is bi-directional. There are many treatises on the subject of heat pipes in "The Proceedings of the 4th Intersociety Energy Conversion Engineering Conference", Washington, D.C., Sept. 22–26, 1969, such as Paper No. 27291, page XIV.

The heat is conducted to the chamber 98 at the top of the cylinder by fins 84, acting as a heat exchanger and causes the gas in the cylinder to expand, forcing the piston 86 downward. As the piston 86 moves downward, it drives fluid under high pressure through a check valve 88 into high pressure accumulator 32. As the piston reaches the bottom of its stroke, the high pressure in the lower chamber 90 of the cylinder falls and the high pressure hydraulic check valve 88 shuts off. The low pressure hydraulic check valve 92 then opens under pressure from the low pressure accumulator 44 and low pressure hydraulic fluid forces the piston upwards.

As the piston 86 went through the cycle just described, its movement caused several things to happen. As the piston 86 of cylinder 80 starts its downward stroke, the gas in the water-cooled lower end 94 of the large cylinder is forced through a line to a regenerator 96 into the hot end 98 of the last cylinder 74. Cooling water is supplied to the cylinder from pump 40, as shown, to cool the gas in lower chamber 94 and then returned to reservoir 38 (FIG. 6). The gas is superheated in chamber 98 of cylinder 74 and the piston 86 moves downward on its power stroke, forcing hydraulic fluid at the bottom end through the high pressure hydraulic fluid check valve 88 and at the same time forcing cool gas in the lower end 94 of cylinder 74 through the next regenerator 96 and into the hot end of cylinder 76. Each successive piston and regenerator works in the same way. The regenerators 96 preheat cool gas coming from the water-cooled end 94 of the cylinders and cools the gas as it comes from the hot end 98 of the cylinders when the piston is in its upward stroke. Only one heat regenerator per piston is shown, however, more may be needed, depending upon the heat capacity required. The interaction between the pistons 86, gas and heat regenerators 96 is a type of Stirling cycle and is very straightforward.

FIG. 8 shows one of the cylinders of FIG. 7 in greater detail. Fins 84 act as a heat exchanger to supply heat from heat pipe 82 to chamber 98. In FIG. 8, a bi-directional flow of gas is shown through line 95 into chamber 94 from a source of expandable gas. Details are not shown in FIGS. 6 and 7 to avoid further complicating the drawings. Additional gas is introduced during acceleration and bled off during deceleration. This procedure is standard in Stirling cycle engines and the method of application is somewhat arbitrary. No fixed method is prescribed herein, rather the anticipated use of the technique is cited for reference.

The hydraulic interaction at the lower end 90 of the pistons is a little more complicated. As piston 86 of cylinder 80 begins to move downward, the lower piston ring 100 passes a port 102 leading to a cushioning valve 104 and a spool valve 106. The hydraulic pressure in the line to cushioning valve 104 then drops to zero or near zero. The cushioning valve 104 prevents the spool valve from operating instantaneously and its reaction time should be adjustable. When the spool valve 106 opens, low pressure hydraulic fluid flows through check valve 92 to the cylinder 76, which is at the bottom of its stroke. The piston 86 of cylinder 76 therefore may not operate until the first piston 86 of cylinder 80 operates. The position of the fluid port controlling the spool valve 106 in cylinder 80 assures 180° separation between these two pistons.

As the piston 86 of cylinder 80 continues to move downward, the piston ring 100 (or rings) pass the fluid port 108 leading to another cushioning valve 110 and spool valve 112. This port is located at the mid-point of the piston stroke or 90 mechanical degrees of the piston cycle. As the ring 100 passes the port 108, the pressure in the line to the cushioning valve 110 drops and the adjacent spool valve 112 operates, allowing low pressure hydraulic fluid to flow through a check valve 92 to the adjacent cylinder 78, which will be at the bottom or 180° of its stroke. Of course, the first piston cylinder 80 and the adjacent piston cylinder 78 are 90° apart in phase so that when the first piston cylinder 80 has reached the mid-point of its downward movement, the adjacent piston cylinder 78 is at the bottom when the spool valve 112 opens to allow the low pressure hydraulic fluid to flow into the chamber 90.

At the same time that the first piston cylinder 80 is at its mid-point on the way down, the third piston cylinder 76 is at its mid-point on the way up. As the lower ring 100 on the third piston 86 of cylinder 76 passes the fluid port 114 leading to a cushioning valve 116 and a spool valve 118, the pressure on the spool valve 118 is restored and it shuts off the fluid flow to the last piston 86 of cylinder 74 through a check valve 92. The mid-point location of the fluid port 114 leading to the cushioning valve 116 assures 90° phase separation between the third and fourth piston cylinders 76 and 74.

When the output power demand goes to zero, the pressure in the high pressure accumulator 32 fills to the maximum deliverable by the pistons and a flow rate indicator will "tell" the heat generating source 72 through a feedback line indicated at 31 to retard its output. Besides storing high pressure fluid for use on demand by hydraulic motors or turbines, the accumulator 32 acts to smooth the pulsations of the individual piston strokes. Hydraulic output control valves 36 and 36′, which may be throttle valves, if desired, control the power flow to the hydraulic power units which may be hydraulic motors or turbines, or whatever device is dictated by the use for which the system is employed.

Fluid for the entire cycle is stored in a main reservoir 38 which should be maintained at a pressure which will not allow the low pressure hydraulic recycle pump 40 to flash and yet low enough that for maximum efficiency the pressure gradient across the hydraulic power units 37 and 37′ is maximum. Cooling of the fluid in the main reservoir 38 will probably be required. A fan 39, radiator, or other cooling device may be employed.

A low pressure recycle pump 40 supplies the hydraulic pressure to operate all the valves and recycle the pistons, as described at length above, through a hydraulic check valve 42 and a low pressure hydraulic accumulator 44. The hydraulic check valve 42 acts to isolate the pressure of the low pressure hydraulic accumulator 44 from the recycle pump. Also, the low pressure hydraulic accumulator 44 stores hydraulic fluid under pressure and acts to smooth pumping action of the low pressure recycle pump 40.

Most of the components for both the steam and the hot air systems are readily available and it is merely a matter of selecting the proper units for the particular use required. They must, however, be properly connected and employed to operate in conjunction with the power conversion pistons, as described. An inherent advantage of the system is the capability of efficiency enhancement through a unique arrangement of system components. What is proposed here is that the power output units 37 and 37′ be hydraulic motors of the variable displacement motor/pump design. The variability in displacement may be achieved by varying the pitch of a complate (not shown). By varying the pitch until the plate passes through the perpendicular and the pitch is reversed, the motor can be made to act as a pump. By the simple expedience of using the motor as a motor during acceleration, and as a pump during deceleration, a large portion of the energy normally given up to braking can be reclaimed and used during future acceleration.

Whether one wants to maintain a single high pressure accumulator 32 or more than one to accommodate pumping and motor operation modes would depend on the application for which the system is used. In the case where an automotive application is considered, there will be energy differences and speed differences based on the vehicle, be it anything from a truck to a sports car, which will encompass a power range far too comprehensive to cover with a flat statement about "automotive applications." An overall increase in energy conversion efficiency can be realized by utilizing the concept of regenerative braking.

Thus, there has been disclosed several types of fluid pressure power plants which operate on a demand cycle and are adaptable to variable power output requirements. The ability to build the system in modular form is certain to increase reliability and enhance maintenance requirements. Also, high turn-down ratios (i.e. full power to idle power) on the order of 100 to 1 are common among present day power plants which make clean burning over the wide range of throttle settings required nearly impossible. However, the power system disclosed herein has only one speed of "on operation" because of resonant piston operation, which means the entire heat cycle may be optimized to function both cleanly and efficiently at a single speed and thereby enhance overall system performance.

This invention has been discussed only as an external combustion device, however, any method for generation of the high pressure gaseous energy required to drive the pistons is possible. These generation schemes may be either internal or external combustion schemes represented by Otto, Diesel, Brayton, Stirling, Ericsson, or Rankine Cycles. Heat energy may be derived from non-combustion sources such as solar, radioisotope, fuel cell, or electric and is therefore not limited to the combustion of hydrocarbon fuels as a source.

Obviously many modifications and variations of the present invention are possible in light of the above teachings. It is therefore to be understood that within the scope of the appended claims the invention may be practiced otherwise than as specifically described.

I claim:

1. A fluid pressure power plant comprising:

a. heat energy generating means for producing hydraulic steam;

b. a double-acting intensifier piston having at least two working area surfaces and at least two hydraulic fluid pumping surfaces;

c. valve means activated by said working area surfaces of said double-acting intensifier piston and hydraulic steam from said heat energy generating means for opening and closing a plurality of steam ports to supply steam expansion chambers containing said working area surfaces of said double-acting intensifier piston with a predetermined minimum amount of steam to efficiently operate said piston by steam expansion at its natural resonance frequency independently of load conditions;

d. first hydraulic fluid valve means for supplying hydraulic fluid from a low pressure reservoir to said hydraulic fluid pumping surfaces;

e. second hydraulic valve means for exhausting hydraulic fluid from said hydraulic fluid pumping surfaces at a high pressure;

f. means for accumulating high pressure hydraulic fluid exhausted by said second hydraulic valve means;

g. means for developing power from said high pressure hydraulic fluid stored in said means for accumulating;

h. means for controlling flow of said high pressure hydraulic fluid from said means for accumulating to said means for developing power; and i. means for returning hydraulic fluid from said means for developing power to said low pressure reservoir.

2. The power plant according to claim 1 wherein said energy generating means comprises:

a. means for generating heat energy; and b. accumulating means for storing the heat energy until there is a demand.

3. The power plant according to claim 2 wherein said double-acting piston comprises:

a. a centrally located cylinder head;

b. steam expansion chambers on either side of said cylinder head; and c. hydraulic fluid chambers on either side of the piston from the cylinder head.

4. The power plant according to claim 1 wherein said valve means comprises:

a. a spool valve which simultaneously controls intake and exhaust from said steam expansion chambers;

b. a pair of valves for controlling operation of said spool valve.

5. The power plant according to claim 4 wherein said pair of valves comprises a separate spool valve on each side of the double-acting piston.

6. The power plant according to claim 5 wherein each valve of said pair has an actuating pin extending into said heat expansion chambers whereby said working area surfaces of said double-acting intensifier piston the alternate opening and closing of said pair of valves as said double-acting piston reciprocates at its natural resonant frequency.

7. The power plant according to claim 1 wherein said valve means comprises:

a. at least one poppet valve in said heat expansion chambers;

b. actuating pin means attached to each said poppet valve causing each said poppet valve to be actuated by contact of said actuating pin means with said working area surfaces; and c. a sliding valve in said double-acting intensifier piston for exhausting said expansion chambers through said double-acting intensifier piston whereby uniflow efficiency is achieved.

8. The power plant according to claim 6 wherein said sliding valve is controlled by said actuating pin means.

9. A method of producing power from heat energy comprising:

a. supplying hydraulic fluid at low pressure to at least one double-acting intensifier piston;

b. generating hydraulic steam;

c. feeding said hydraulic steam to said double-acting intensifier piston causing it to reciprocate in a hydraulic steam expansion cycle at its natural resonant frequency;

d. producing intensified hydraulic fluid pressure from reciprocal motion of said double-acting intensifier piston;

e. accumulating said intensified hydraulic fluid pressure for use on demand;

f. recycling said double-acting intensifier piston with low pressure hydraulic fluid; and g. driving a power unit with power available from said intensified hydraulic fluid pressure.

* * * * *